US007578697B2

(12) United States Patent
Wang et al.

(10) Patent No.: US 7,578,697 B2
(45) Date of Patent: Aug. 25, 2009

(54) ELECTRICAL CONNECTOR WITH CONTACT TERMINALS ISOLATED FROM EACH OTHER WITHIN THE HOUSING

(75) Inventors: Chang-Yin Wang, Kunshan (CN); Wei-Ya Cheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,693

(22) Filed: Aug. 15, 2008

(65) Prior Publication Data

US 2009/0047844 A1 Feb. 19, 2009

(30) Foreign Application Priority Data

Aug. 15, 2007 (CN) ..... 2007 2 0042905 U

(51) Int. Cl.
*H01R 12/24* (2006.01)

(52) U.S. Cl. ..... 439/497; 439/660; 439/722

(58) Field of Classification Search ..... 439/430, 439/449, 452, 460, 497–499, 607, 660, 722, 439/874

See application file for complete search history.

(56) References Cited

U.S. PATENT DOCUMENTS 5,413,506 A * 5/1995 Thompson ..... 439/660
6,106,338 A * 8/2000 Wu et al. ..... 439/660
6,203,352 B1 * 3/2001 Murakami et al. ..... 439/352
6,454,605 B1 * 9/2002 Bassler et al. ..... 439/609
6,457,997 B1 * 10/2002 Fan ..... 439/660
6,652,325 B2 * 11/2003 Tharp et al. ..... 439/660
6,802,744 B2 10/2004 Chiang
7,223,121 B2 * 5/2007 Moriyama et al. ..... 439/497
7,270,571 B1 * 9/2007 Huang et al. ..... 439/607
7,275,955 B2 * 10/2007 Ko ..... 439/498
7,462,071 B1 * 12/2008 Wu ..... 439/608
2002/0132530 A1 * 9/2002 Tharp et al. ..... 439/660
2005/0014418 A1 * 1/2005 Ji et al. ..... 439/660
2009/0047844 A1 * 2/2009 Wang et al. ..... 439/722

* cited by examiner

*Primary Examiner*—James Harvey
(74) *Attorney, Agent, or Firm*—Wei Te Chung

(57) ABSTRACT

An electrical connector (100) according to the present invention includes an insulative housing (1) and a pair of conductive terminals (2). The housing includes a wire connecting portion (11) for connecting a wire and a mating port (10) with a receiving space (101) at the center thereof adapted for receiving a complementary connector, and the wire connecting portion defines a plurality of surfaces. The pair of conductive terminals include mating portions (22) received in the receiving space and soldering portions (21) surface mounted on different surfaces of the wire connecting portion of the housing so that the soldering portion of the terminals is separated by the wire connecting portion of the housing.

16 Claims, 4 Drawing Sheets

ELECTRICAL CONNECTOR WITH CONTACT TERMINALS ISOLATED FROM EACH OTHER WITHIN THE HOUSING

BACKGROUND OF THE INVENTION

1. Field of the Invention

This invention generally relates to an electrical connector, and more particularly, to an electrical connector with contact terminals isolated from each other within the housing.

2. Description of the Prior Art

U.S. Pat. No. 6,802,744 discloses an electrical connector which includes a connector housing, a cable and a plurality of terminals. The terminals are held in the connector housing and each comprises a tail which extends out the connector housing to be soldered to the cable. A wire management member is joint to the connector housing to support the tails of terminals. However, the tails of the terminals are arranged in cantilevered form and are critical before the wire management member is mounted on the connector housing. Moreover, the connector housing has to be wide enough to array the plurality of the terminals in a row.

Hence, an improved electrical connector is desired to overcome the above problems.

BRIEF SUMMARY OF THE INVENTION

It is an object of the present invention to provide an electrical connector with an improved housing which isolates conductive terminals therein.

In order to attain the object above, an electrical connector according to the present invention comprises an insulative housing and a pair of conductive terminals. The housing includes a wire connecting portion for connecting a wire and a mating port with a receiving space at the center thereof adapted for receiving a complementary connector, and the wire connecting portion defines a plurality of surfaces. The pair of conductive terminals include mating portions received in the receiving space and soldering portions surface mounted on different surfaces of the wire connecting portion of the housing so that the soldering portion of the terminals is separated by the wire connecting portion of the housing.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
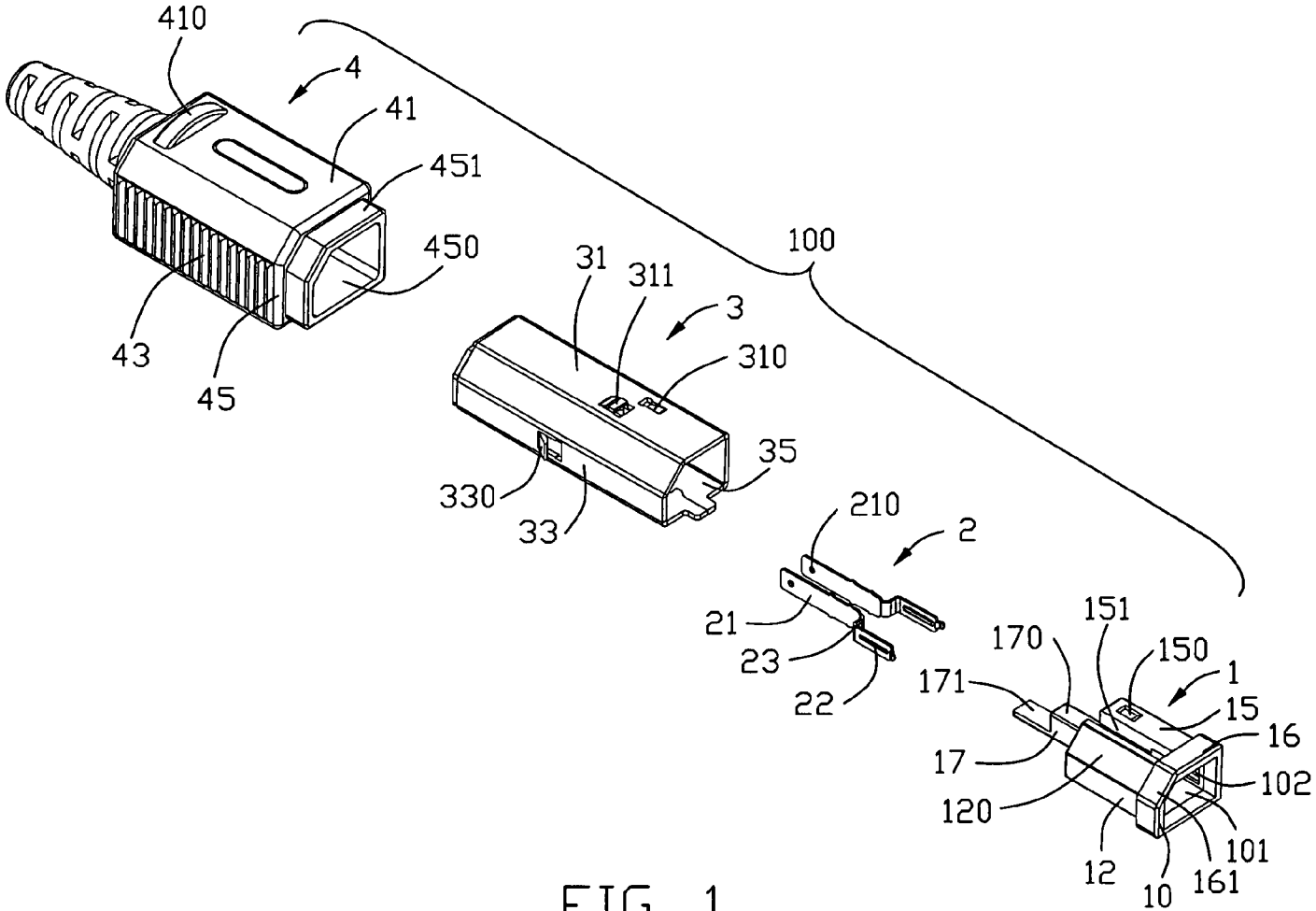
FIG. 1 is an exploded, perspective view of an electrical connector in accordance with the present invention.

Reference will now be made in detail to the preferred embodiment of the present invention.

Please referring to FIGS. 1-4, a power connector 100 according to the present invention comprises an insulative housing 1, a pair of conductive terminals 2 disposed in the housing 1, a conductive shell 3 partially covering the housing 1 and an insulative casing 4 located at the outermost.

Figure 2:
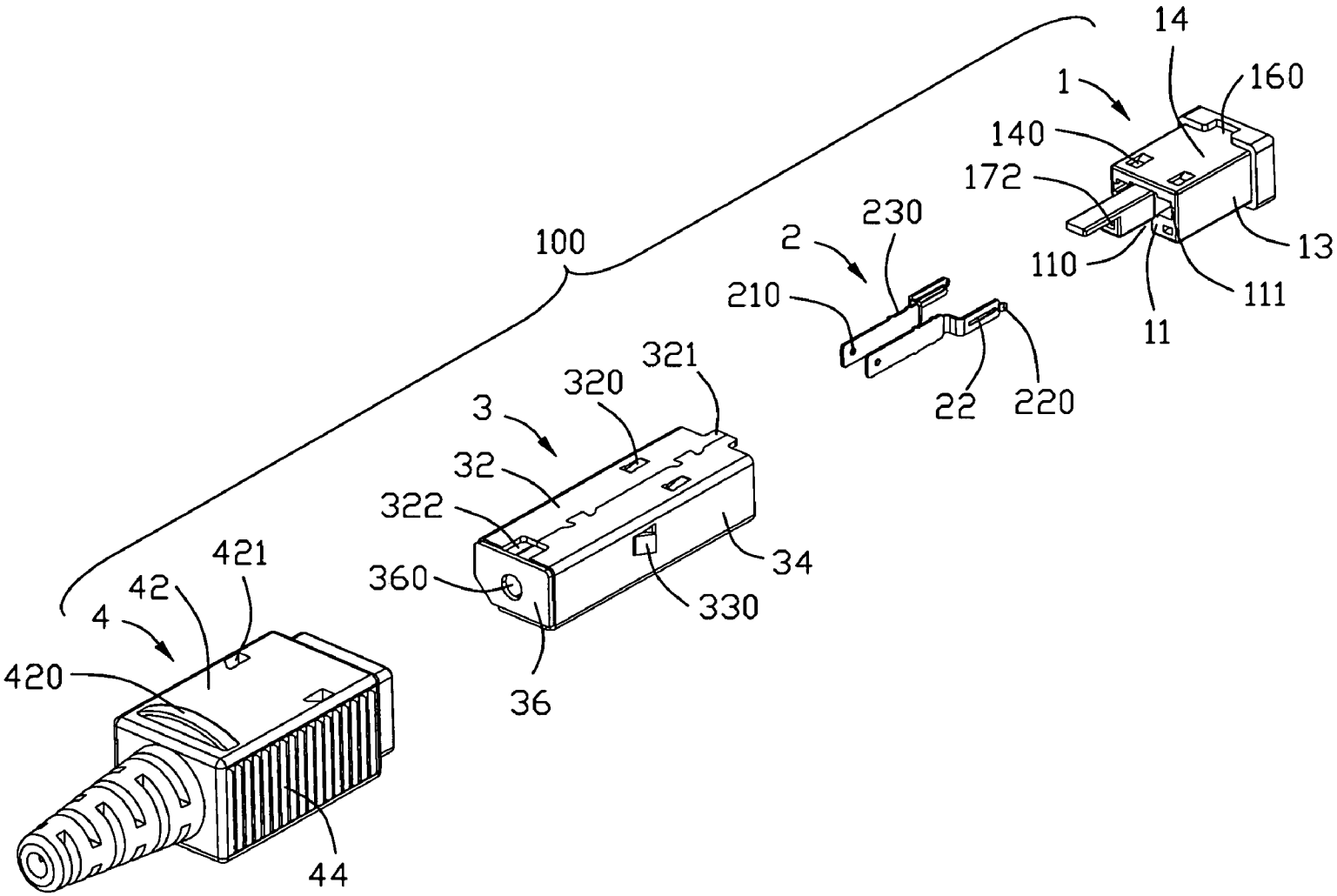
FIG. 2 is a view similar to FIG. 1, but viewed from another aspect.
Figure 3:
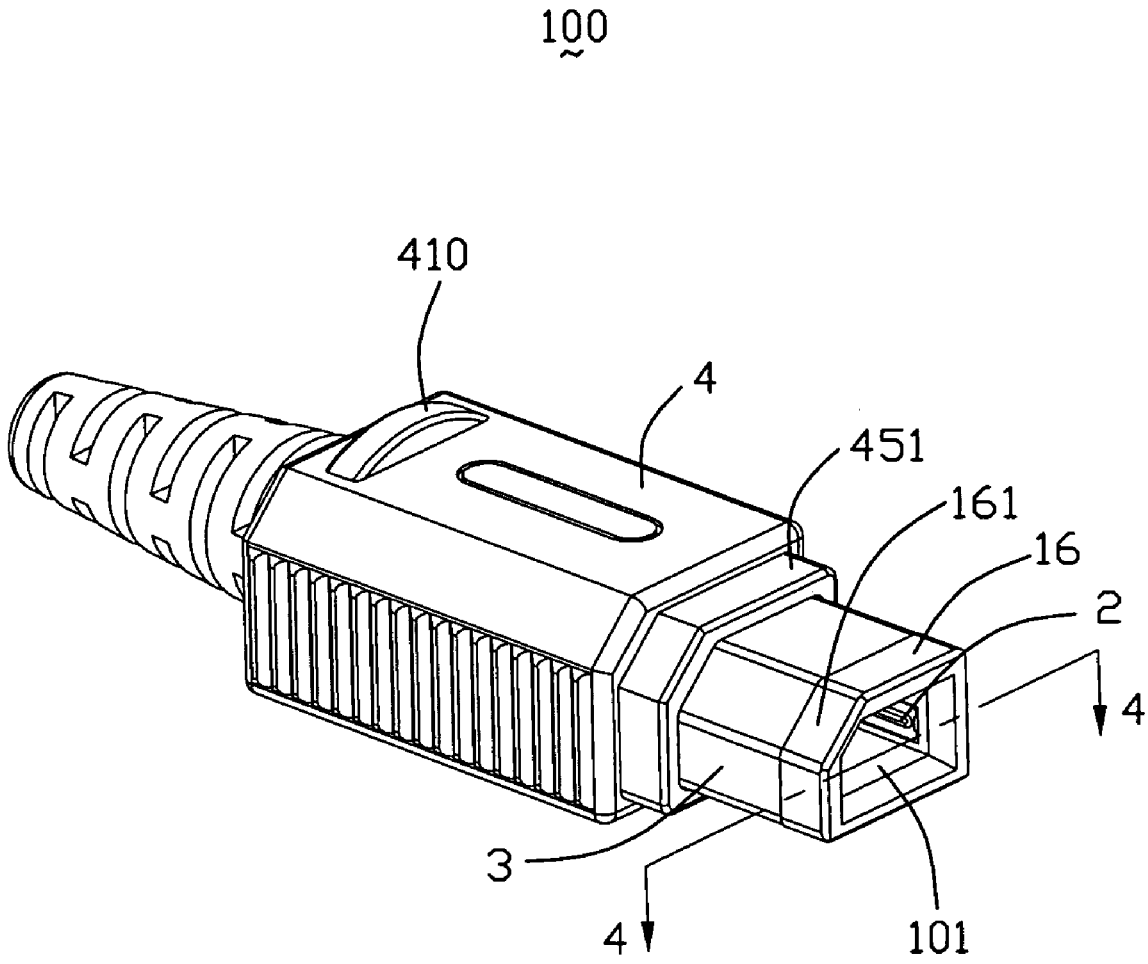
FIG. 3 is an assembled view of an electrical connector shown in FIG. 1.
Figure 4:
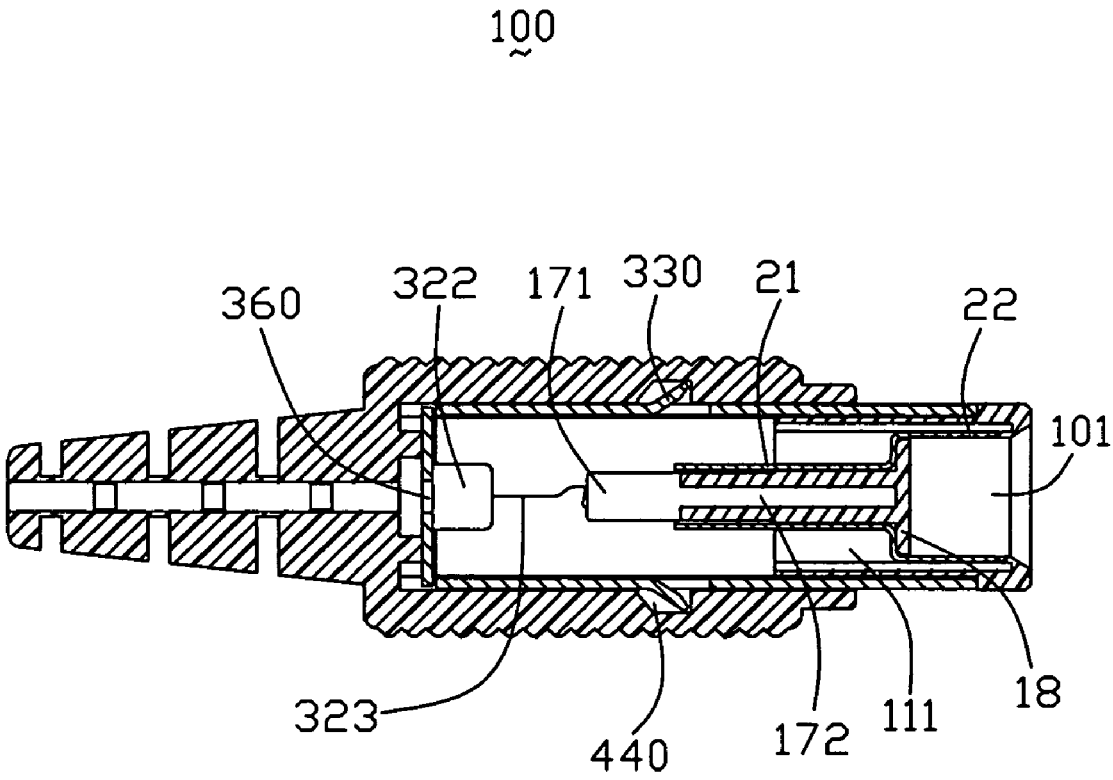
FIG. 4 is a cross-sectional view of FIG. 3 taken along lines 4-4.

Please referring to FIGS. 1-2, the housing 1 defines a front portion 10, a rear portion 11, a pair of sidewalls 12, 13, and top and bottom walls 15 and 14. The front portion 10 stands at the front of the housing 1 and comprises an annular enlargement portion 16 which has a notch 160 and an inclined surface 161. The rear portion 11 forms a step portion 17 at the rear thereof, the rear portion 17 having a projection 170 and a supporting plate 171 extending backwards from a lower end of the projection 170 for supporting a cable (not shown). The projection 170 forms at the center thereof a cavity 172 with a stopper wall 18, and there are a pair of gaps (not shown) between the stopper wall 18 and the sidewalls 12 and 13 to facilitate the terminals 2 to enter the front portion 10. There are a pair of chambers 111 between the step portion 17 and the sidewalls 12 and 13 to communicate with the corresponding gaps, and each chamber 111 has a terminal passageway 110 adjacent to the step portion 17 to receive a terminal 2. The sidewall 12 has an inclined surface 120, and the sidewall 13 is of rectangular. A pair of grooves 102 are depressed in inner surfaces of the sidewalls 12 and 13, and extend backwards from the enlargement portion 16 to the stopper wall 18. The stopper wall 18 extends vertically and connects the grooves 102 and the terminal passages 110. The housing 1 defines a receiving cavity 101 at its center to receive a complementary connector (not shown). The receiving cavity 101 extends backwards from a front surface of the front portion 10 to the stopper wall 18 and communicates with the grooves 102. The top wall 15 has a rectangular indentation 150 and a channel 151 which extends forwards from the projection 170 and communicates with the receiving cavity 101. The bottom wall 14 stands in a horizontal surface and has a pair of hollows 140.

The pair of terminals 2 have the same configuration and each has a soldering portion 21, a mating portion 22 and a Z-shaped connecting portion 23. The soldering portion 21 forms a through-hole 210 for facilitating the soldering to the cable. The connecting portion 23 has a plurality of sawteeth 230 on its upper and lower edges to hold the terminal 2 in the housing 1. The mating portion 22 comprises an embossed strip (not labeled) extending inwards from an inner surface of the mating portion 22 to contact a complementary connector, and a tip 220 at a free end for engaging with the housing 1 and guiding the complementary connector in contact with the mating portion 22. The distance between the pair of the mating portions 22 is farther than that of the soldering portions 21.

The conductive shell 3 is made of a single metal plate, and comprises a top wall 31, a bottom wall 32 and a pair of first and second sidewalls 33 and 34 facing to each other. The top and bottom walls 31 and 32 have a plurality of spring tabs 310 and 320 which extend inwards and backwards to engage with the rectangular indentation 150 and the hollows 140 of the housing 1. The top wall 31 and sidewalls 33 and 34 have a plurality of spring tabs 311 and 330 which extend forwards and outwards. The bottom wall 32 forms a ligule 321 at its front end to engage with the notch 160, and a rectangular hole 322 at the rear end. A rear wall 36 with a round hole 360 at its center is formed in the rear of the shell 3, and the round hole 360 is used for a cable to pass through.

The casing 4 covers the shell 3 and comprises a top wall 41, a bottom wall 42 and a pair of sidewalls 43 and 44. The top and bottom walls have a recess (not shown) to engage with the spring tab 311 of the shell, and a pair of arcuated protrusions 410 and 420. The sidewalls 43 and 44 have a plurality of wrinkles (not labeled) to enlarge friction against the casing 4 and a pair of recesses 440 (referring to FIG. 4) to engage with the spring tabs 330 of the shell 3. The recesses 440 extend downwards through the bottom wall 42 to form a pair of openings 421. A front portion 45 is formed at the front of the casing 4 and comprises a ring-shaped flange 451 and a receiving space 450 at its center. The receiving space 450 extends forwards into the rear end of the casing 4 to receive the shell 3.

In assembly, firstly the terminal 2 are inserted the housing 1 along the projection 170. The mating portions 22 pass through the gaps between the stopper wall 18 and the sidewalls 12 and 13 are disposed in the grooves 102, the connecting portions 23 abut against the stopper wall 18 with the sawteeth 230 engaging with the housing 1 to hold them together, and the soldering portions 2 are received in the terminal passages 110 and spaced each other by the projection 170. Secondly, the shell 3 encloses the housing 1, the ligule 321 engaging with the notch 160 of the housing 1, the spring tabs 320 and 310 respectively engaging with the hollows 140 and the indentation 150. Finally, the casing 4 slides along a rear-to-front direction to partially enclose the shell 3, with the recesses 440 (the recess of the top wall 41 not shown) engaging with the spring tabs 311 and 330. Please referring to FIG. 3, the annular enlargement portion 16 of the housing 1 and front part of the shell 3 constitute a mating port of the power connector 100 which is used to inserted into the complementary connector. Front surface of the ring-shaped flange 451 abuts against a front surface of the complementary connector and is named as mating surface.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing comprising a wire connecting portion for connecting a wire and a mating port with a receiving space at the center thereof adapted for receiving a complementary connector, the wire connecting portion defining a plurality of surfaces; and a pair of conductive terminals having mating portions received in the receiving space and soldering portions surface mounted on different surfaces of the wire connecting portion of the housing so that the soldering portions of the terminals are separated by the wire connecting portion of the housing;

wherein the housing and wire connection portion are monolithically formed as a single unit;

wherein the wire connecting portion of the housing further comprises a supporting plate at its free end to support a wire which is soldered to the soldering portions of the terminals.

2. An electrical connector comprising:

an insulative housing comprising a wire connecting portion for connecting a plurality of wires, and a mating port with a receiving space at the center thereof adapted for receiving a complementary connector, the wire connecting portion defining a plurality of surfaces extending in a front-to-back direction, and a rearwardly extending supporting plate;

a pair of conductive terminals having mating portions received in the receiving space and soldering portions surface mounted on different surfaces of the wire connecting portion of the housing so that the soldering portions of the terminals are separated by the wire connecting portion of the housing; and the supporting plate supports said wires;

wherein the housing and wire connection portion are monolithically formed as a single unit.

3. The electrical connector as recited in claim 1, wherein the soldering portion of the terminal forms a through hole to facilitate the soldering to the wire.

4. The electrical connector as recited in claim 1, wherein the mating portion of the terminal forms an embossed strip on its inner surface for a good electrical connection with a complementary connector.

5. The electrical connector as recited in claim 1, wherein the mating portion of the terminal forms a tip at its free end for engaging with the housing and guiding a complementary connector in contact with the mating portion.

6. The electrical connector as recited in claim 1, wherein the pair of terminals have the same configuration.

7. The electrical connector as recited in claim 1, wherein the housing comprises a top wall, a bottom wall, a rear wall and a pair of sidewalls which jointly define the mating port, and wire connecting portion extends backwards from the center of the rear wall.

8. The electrical connector as recited in claim 7, wherein the wire connecting portion comprises a rectangular pole on which the soldering portions of the terminals are surface mounted and a supporting plate extending backwards from a lower end of the rectangular pole for supporting the wire.

9. The electrical connector as recited in claim 1, wherein a metal shell encloses the housing.

10. An electrical connector, comprising:

an insulative housing defining a mating port for mating with another connector at its front end and a wire connecting portion at its rear end, the housing forming a hollow on its periphery;

a conductive terminal disposed in the housing;

a wire extending to the wire connecting portion of the housing and electrically connecting the terminal;

a metal shell forwards moving to be mounted on and enclose the housing, the shell comprising a first spring tab which extends backwards and inwards for engaging with the hollow to prevent the shell from withdrawing and a second spring tab which extends forwards and outwards; and an insulative casing comprising a base enclosing the shell and a sleeve which extends backwards from the base and is configured to enclose and slide along the wire so as to be mounted on the shell, the casing forming a recess for engaging with the second spring tab to prevent the casing from withdrawing.

11. The electrical connector as recited in claim 10, wherein the recess of the casing vertically passes through the casing.

12. The electrical connector as recited in claim 10, wherein the shell comprises a plurality of sidewalls connecting to each other to define a space for receiving the housing and a rear wall for covering the space of the shell, and the rear wall forms a through hole at its center to just allow the wire into the space.

13. The electrical connector as recited in claim 12, wherein a knot is tied in the wire to prevent the wire from withdrawing after the wire passes through the through hole of the shell.

14. The electrical connector as recited in claim 10, wherein the electrical connector comprises at least two conductive terminals each having a soldering portion which is soldered to the wire, and the housing comprises a rear portion which isolates the soldering portions.

15. The electrical connector as claimed in claim 2, wherein said wire connecting portion is a hollow rectangular post.

16. The electrical connector as claimed in claim 2, wherein said different surface face toward not only a vertical direction perpendicular to said front-to-back direction, but also a transverse direction perpendicular to both said vertical direction and said front-to-back direction.

* * * * *